United States Patent [19]

Lembeck

[11] Patent Number: 4,640,090

[45] Date of Patent: Feb. 3, 1987

[54] FIBER CONDUCTING CHANNEL OF AN OE FRICTION SPINNING DEVICE

[75] Inventor: Theo Lembeck, Moenchengladbach, Fed. Rep. of Germany

[73] Assignee: W. Schlafhorst & Co., Moenchengladbach, Fed. Rep. of Germany

[21] Appl. No.: 820,402

[22] Filed: Jan. 17, 1986

[30] Foreign Application Priority Data

Jan. 25, 1985 [DE] Fed. Rep. of Germany ..... 3502427

[51] Int. Cl.[4] ..... D01H 7/898

[52] U.S. Cl. ..... 57/401

[58] Field of Search ..... 57/90, 400, 401, 408, 57/411, 415

[56] References Cited

U.S. PATENT DOCUMENTS

| | | | |
|---|---|---|---|
| 4,202,163 | 5/1980 | Turk et al. | 57/401 |
| 4,241,571 | 12/1980 | Turk et al. | 57/401 |
| 4,570,434 | 2/1986 | Stahlecker | 57/401 |

*Primary Examiner*—Donald Watkins

*Attorney, Agent, or Firm*—Herbert L. Lerner; Lawrence A. Greenberg

[57] ABSTRACT

An OE friction spinning device having a fiber loosening device and device for forming a spinning wedge, improvement includes a fiber conducting channel having a wall, a device for generating a transporting air current in the fiber conducting channel for carrying fibers from the fiber loosening device to the spinning wedge, the wall having at least two openings formed therein being spaced from each other along the transporting air current for the passage of guiding air forming at least one guiding air stream parallel to the transporting air current in the fiber conducting channel.

12 Claims, 2 Drawing Figures

FIBER CONDUCTING CHANNEL OF AN OE FRICTION SPINNING DEVICE

The invention relates to a fiber conducting channel of an OE (open end) spinning device for conducting a transporting air current carrying fibers from a fiber loosening device to a spinning wedge.

The friction elements of an OE friction spinning device may be perforated drums which rotate in the same direction, have mutually parallel axes of rotation and are disposed so close to each other that two wedges are formed parallel to the axes of rotation, one of the wedges being used as a spinning wedge. The fiber conducting channel conducts the fibers from a fiber loosening device to the spinning wedge, into which the loosened fibers are discharged along a narrow thread forming zone.

The interior of at least one perforated drum has a suction device with a relatively narrow but long air suction slot which is directed toward the spinnig wedge. The fibers are held in a fixed condition on the surface of the perforated drum opposite the air suction slot or slots and are twisted by friction, forming a thread which is continuously pulled out parallel to the axes of rotation of the perforated drum.

Inside the fiber conducting channel, the fibers float in a transporting air current, which is generated by a suction device provided in the interior of at least one of the friction elements.

Due to the turbulent flow conditions in the fiber conducting channel, at the end of the fiber conducting channel, at the transition zone into the suction devices of the friction elements and inside the suction devices themselves, the fiber always have the tendency to adhere, especially at the wall sections of the fiber conducting channel which lie opposite the spinning wedge. At those locations, the fibers form irregular fiber concentrations which from time to time break loose, so that a bunched quantity of fibers flows into the spinning wedge. The result is that an uneven thread is produced.

It is accordingly an object of the invention to provide a fiber conducting channel of an OE friction spinning device, which overcomes the hereinafore-mentioned disadvantages of the heretofore-known devices of the general type, which improves the quality of the thread in OE friction spinning devices and which especially makes the thread more uniform.

With the foregoing and other objects in view there is provided, in accordance with the invention, of an OE friction spinning spinning device having a fiber loosening device and means for forming a spinning wedge, the improvement comprising a fiber conducting or guiding channel having a wall, means for generating a transporting air current in the fiber conducting channel for carrying fibers from the fiber loosening device to the spinning wedge, the wall having at least two opening formed therein being spaced from each other along the transporting air current for the passage of guiding air forming at least one guiding air stream parallel to the transporting air current in the fiber conducting channel.

This guiding air stream prevents the fibers from adhering to the walls. Furthermore, the guiding stream has a quieting influence on the transporting air current, so that the fiber stream reaches the spinning wedge in a very uniform and well distributed manner.

In accordance with another feature of the invention the wall has a portion disposed opposite the spinning wedge and the openings are formed at least in the wall portion. This is done because it is the location at which the causes that disturb the uniform fiber flow occur most frequently. In accordance with a further feature of the invention the guiding air flow is conducted at least along the wall portion. This done for the same reason.

In accordance with an added feature of the invention the transporting air current and the guiding air flow have different flow velocities. This is done so that a boundary layer can be formed which prevents the fibers from entering into the guiding air stream and thereby reaching the walls.

In accordance with an additional feature of the invention at least one of the openings is disposed in the vicinity of the fiber loosening device. In this way the advantages of the guiding air stream are obtained as soon as possible and maintained longer.

In accordance with again another feature of the invention at least one of the openings is an outlet for the guiding air. The determination as to whether or not an outlet opening for the guiding air stream is necessary at all depends essentially on the ratio of the amount of guiding air to the amount of transporting air.

In accordance with again a further feature of the invention there is provided a suction air source connected to the outlet for providing suction air.

In accordance with again an added feature of the invention the wall has a front disposed closest to the fiber loosening device and a rear disposed closest to the spinning wedge, the outlet being disposed at the rear of the wall.

In accordance with again an additional feature of the invention there is provided a pressurized chamber in communication with the openings. This construction provides several possibilities. All of the wall openings may be connected to a pressurized chamber, all of the wall openings may be connected with a chamber under normal pressure, several of the wall openings may be connected to a pressurized chamber while others are connected with a chamber under normal pressure, or at least one air outlet opening is provided and the other wall openings are supplied with guiding air in the above-mentioned combinations.

In accordance with a concomitant feature of the invention the openings are in the form of perforations. Perforations permit a greater number of wall openings having cross-sectional areas that can be relatively small. If the wall openings are small holes for some other applications, lesser openings can be provided, but the cross section of each opening can be larger.

With small perforations, the supply of guiding air can be very uniformly distributed over the length of the fiber conducting channel, but if holes are used as the wall openings, their cross-sectional area can be varied along the length of the fiber conducting channel, for example, so that their cross sections becomes smaller as seen in the direction in which the fibers are conducted.

Other features which are considered as characteristic for the invention are set forth in the appended claims.

Although the invention is illustrated and described herein as embodied in a fiber conducting channel of an oe friction spinning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
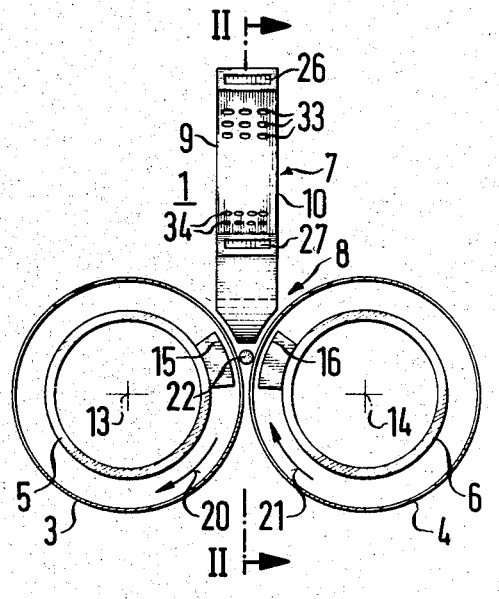
FIG. 1 is a diagrammatic, front-elevational view of the device according to the invention.
Figure 2:
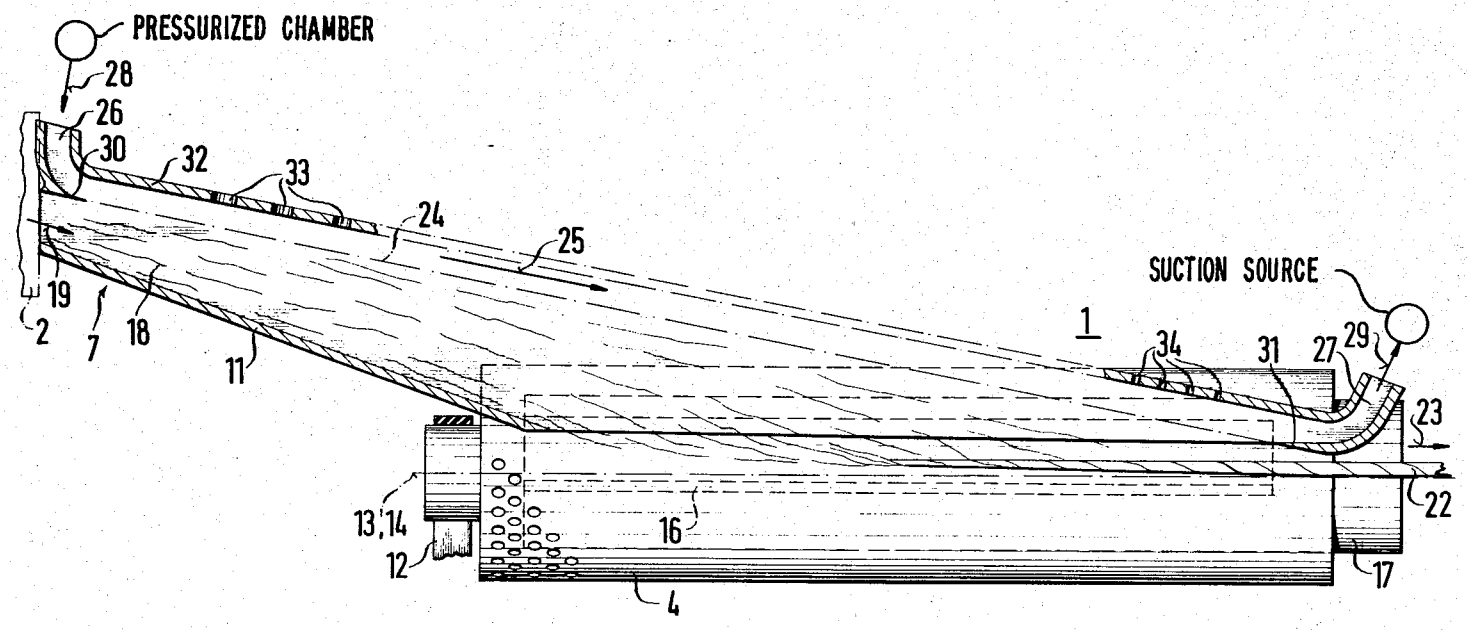
FIG. 2 is a cross-sectional view taken along the line II—II in FIG. 1, in the direction of the arrows.

Referring now to the figures of the drawings in detail, there is seen an OE (Open End) friction spinning device 1, including a fiber loosening device 2, two rotatable friction elements 3 and 4, two suction devices 5 and 6 located inside the friction elements 3 and 4, a non-illustrated thread pulling and winding device, and a fiber conduction channel 7 with side walls 9, 10, 11 which lead straight from the fiber loosening device 2 into a spinning wedge 8.

The friction elements 3 and 4 are constructed in the form of rotatably supported drums, which can be driven by tension or pulling means 12. The suction devices 5 and 6 which are stationarily disposed in the interior of the perforated drums, are formed of tubes which are disposed concentric to axes of rotation 13, 14, respectively. The tubes are provided with suction slots 15, 16, respectively which are directed toward the spinning wedge 8. The suction devices 5 and 6 end in a short suction pipe 17, which is connected to a non-illustrated suction source.

The suction air flowing into the suction slots 15 and 16 generates a transporting air current 19 which carries and transports fibers 18.

Both friction elements 3 and 4 rotate in the same sense, the friction element 3 in the direction of an arrow 20 and the friction element 4 in the direction of an arrow 21. Individual fibers are pulled from sliver which is continuously supplied in the fiber loosening device 2, transporting air current moves the fibers into the spinning wedge 8 where the thread is formed by the rotation of the friction elements 3 and 4, the thread is continuously pulled in the withdrawal direction by non-illustrated means and is subsequently wound up forming a spool.

A conventionally constructed fiber conduction channel would have a sidewall along a dot-dash line 24 on the side opposite the spinning wedge 8. In this case such a side wall is formed, so to speak, by a guiding air current 25, which flows parallel to the transporting air current 19 that carries and transports the fibers 19.

The beginning of the fiber conduction channel 7 has an opening in the wall at the side opposite the spinning wedge 8 serving as an entering air inlet for the guiding air current 25 and the end of the channel 7 has an opening in the wall serving as an exiting air outlet 27 for the guiding air current 25. The air flows into the air inlet 26 in the direction of an arrow 28. The air flows to a non-illustrated suction air source in direction of an arrow 29. The air inlet is provided with a flow guidance edge 30 which extends parallel to the transporting air current 19, and the air outlet 27 is provided with a flow guidance edge 31.

A channel wall 32 is disposed between the air inlet 26 and the air outlet 27 at the side facing away from the spinning wedge 8.

Several air inlet openings may be provided instead of only one, which can be advantageously positioned along the channel wall. Ambient air could be sucked into these inlets.

Additionally or alternatively, wall openings in the channel wall may be provided in the form of holes 33 or perforations 34.

The invention is not limited to the illustrated and discribed embodiment which was used as an example. For example, the wall openings could be provided in a fiber conducting channel with a different cross section and according to the invention, the openings could also be positioned in other parts of the wall.

The foregoing is a description corresponding in substance to German application No. P 35 02 427.5 filed Jan. 25, 1985, the International priority of which is being claimed for the instant application, and which is hereby made part of this application. Any material discrepancies between the foregoing specification and the aforementioned corresponding German application are to be resolved in favor of the latter.

I claim:

1. In an OE friction spinning spinning device having a fiber loosening device and means for forming a spinning wedge, the improvement comprising a fiber conducting channel having a wall, means for generating a transporting air current in said fiber conducting channel for carrying fibers from the fiber loosening device to the spinning wedge, said wall having at least two openings formed therein being spaced from each other along said transporting air current for the passage of guiding air forming at least one guiding air stream parallel to said transporting air current in said fiber conducting channel.

2. Fiber conducting channel according to claim 1, wherein said wall has a portion disposed opposite the spinning wedge and said openings are formed at least in said wall portion.

3. Fiber conducting channel according to claim 1, wherein said wall has a portion disposed opposite the spinning wedge and said guiding air flow is conducted at least along said wall portion.

4. Fiber conducting channel according to claim 2, wherein said guiding air flow is conducted at least along said wall portion.

5. Fiber conducting channel according to claim 1, wherein said transporting air current and said guiding air stream flow at different flow velocities.

6. Fiber conducting channel according to claim 1, wherein at least one of said openings is disposed in the vicinity of said fiber loosening device.

7. Fiber loosening device according to claim 1, where at least one of said openings is an outlet for the guiding air.

8. Fiber loosening device according to claim 7, including means connected to said outlet for providing suction.

9. Fiber conducting channel according to claim 7, wherein said wall has a front disposed closest to the fiber loosening device and a rear disposed closest to the spinning wedge, said outlet being disposed at said rear of said wall.

10. Fiber conducting channel according to claim 8, wherein said wall has a front disposed closest to the fiber loosening device and a rear disposed closest to the spinning wedge, said outlet being disposed at said rear of said wall.

11. Fiber conducting channel according to claim 1, including a pressurized chamber in communication with said openings.

12. Fiber conducting channel according to claim 1, wherein said openings are in the form of perforations.

* * * * *